United States Patent [19]

Strongin

[11] 3,978,611

[45] Sept. 7, 1976

[54] TOY FIGURE WITH PISTOL DRAW ACTION

[75] Inventor: Ned Strongin, Baldwin, N.Y.

[73] Assignee: Ned Strongin Associates, Inc., New York, N.Y.

[22] Filed: May 14, 1975

[21] Appl. No.: 577,530

[52] U.S. Cl. ..... 46/118

[51] Int. Cl.[2] ..... A63H 5/00

[58] Field of Search ..... 46/142, 148, 117, 118, 46/119, 175 R, 1 G; 273/1 R, 1 E

[56] References Cited

UNITED STATES PATENTS

| | | | |
|---|---|---|---|
| 2,535,402 | 12/1950 | Fleishman | 46/118 |
| 2,580,413 | 1/1952 | Dietze, Jr. | 46/118 |
| 3,082,573 | 3/1963 | Kantz | 46/148 X |

FOREIGN PATENTS OR APPLICATIONS

| | | | |
|---|---|---|---|
| 642,120 | 6/1962 | Canada | 46/118 |
| 735,403 | 8/1955 | United Kingdom | 46/118 |

*Primary Examiner*—Louis G. Mancene
*Assistant Examiner*—Jack Q. Lever
*Attorney, Agent, or Firm*—Blum, Moscovitz, Friedman & Kaplan

[57] ABSTRACT

A toy figure which is fully articulated has a pistol mounted in one hand. For play action, the pistol is positioned in a holster and, upon operation of a lever, the pistol is withdrawn from the holster and extended to a firing position and a noise simulating the firing of the pistol is generated substantially concurrently with the pistol attaining the firing position.

6 Claims, 7 Drawing Figures

FIG. 4
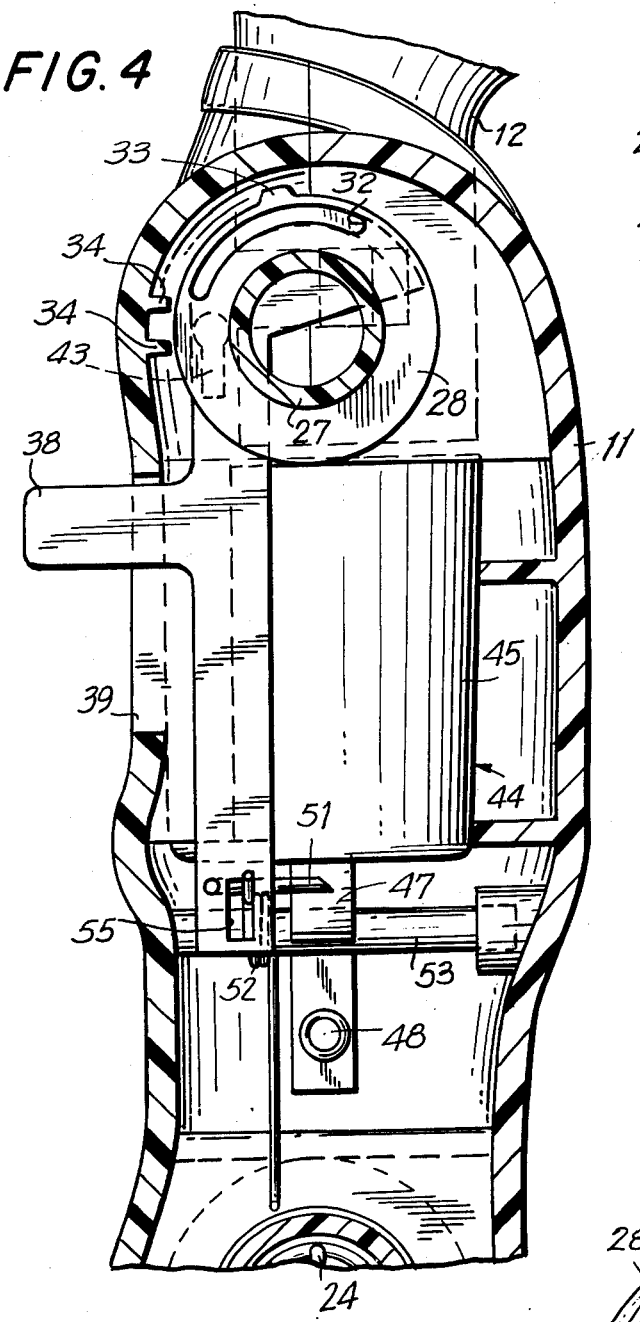
FIG. 6
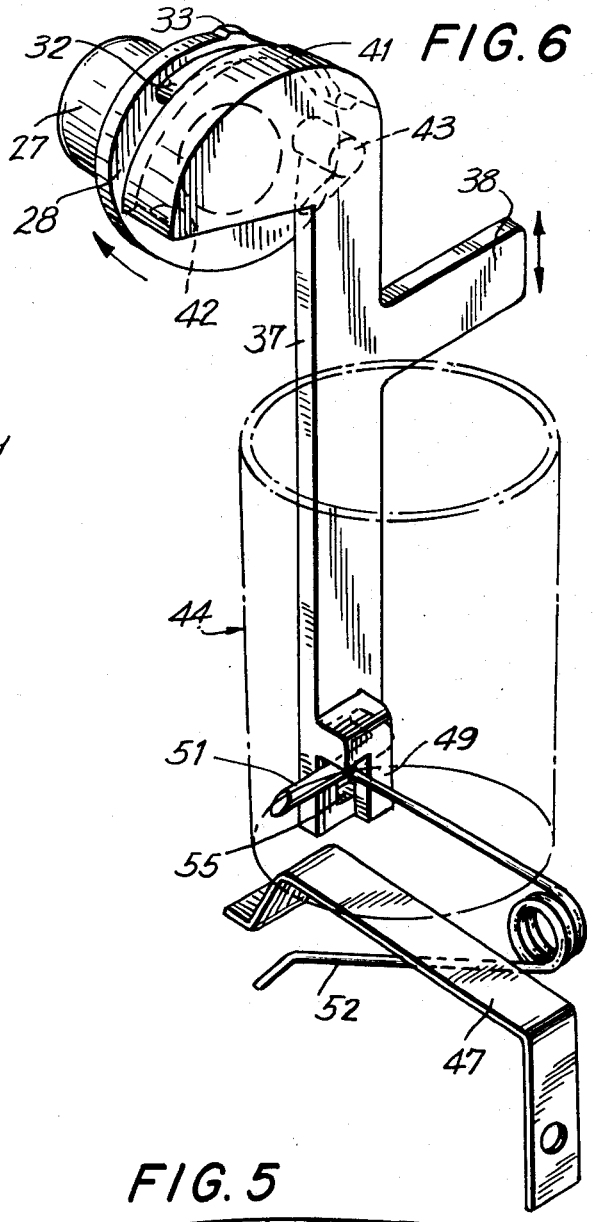
FIG. 5
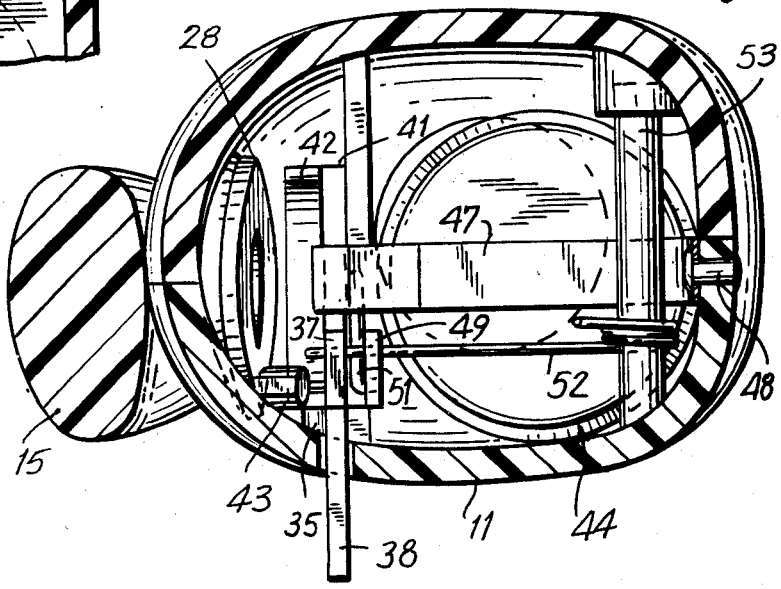
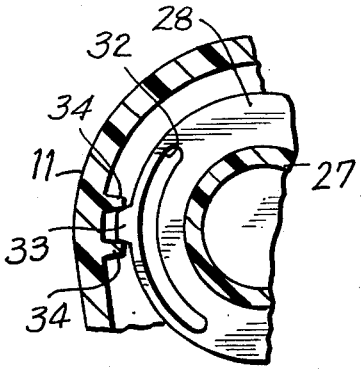
FIG. 4A

TOY FIGURE WITH PISTOL DRAW ACTION

BACKGROUND OF THE INVENTION

This invention relates generally to a toy figure provided with a pistol draw action. Toy figures simulating soldiers, cowboys and the like have substantial play value and children will often collect sets of figures which are used to simulate a battle. Articulated figures permit the figures to be manipulated into lifelike positions and have a demonstrated enhanced play value.

SUMMARY OF THE INVENTION

Generally speaking, in accordance with the invention, an articulated toy figure is provided with means to simulate pistol draw action. A hand of the figure carries a pistol which may be positioned in a holster when the arm is in a lowered position. When a level is operated, the arm is raised to a firing position thereby withdrawing the pistol from the holster and a sound is generated as the pistol reaches the firing position to simulate the sound of the pistol being fired.

Accordingly, it is an object of this invention to provide an improved toy figure with pistol draw action.

Another object of the present invention is to provide a toy figure with pistol draw action to simulate a pistol being drawn and fired.

A further object of the invention is to provide a toy figure incorporating a mechanism for simulating pistol draw and firing.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 4 is a partial sectional view taken along line 4—4 of FIG. 3;

FIG. 4A. is a partial sectional view of a portion of the operating mechanism of FIG. 4 corresponding to the pistol firing position;

FIG. 5 is a partial sectional view taken along line 5—5 of FIG. 3; and

FIG. 6 is a partial perspective view of the mechanism for moving the pistol from the holster to the firing position and for generating the firing simulating sound.

DESCRIPTION OF THE PREFERRED EMBODIMENTS

Figure 2:
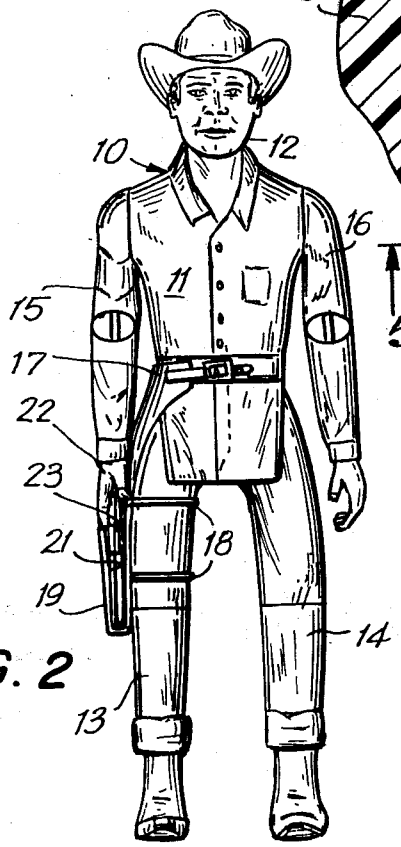
FIG. 2 is a front elevational view of the toy figure of FIG. 1.
Figure 1:
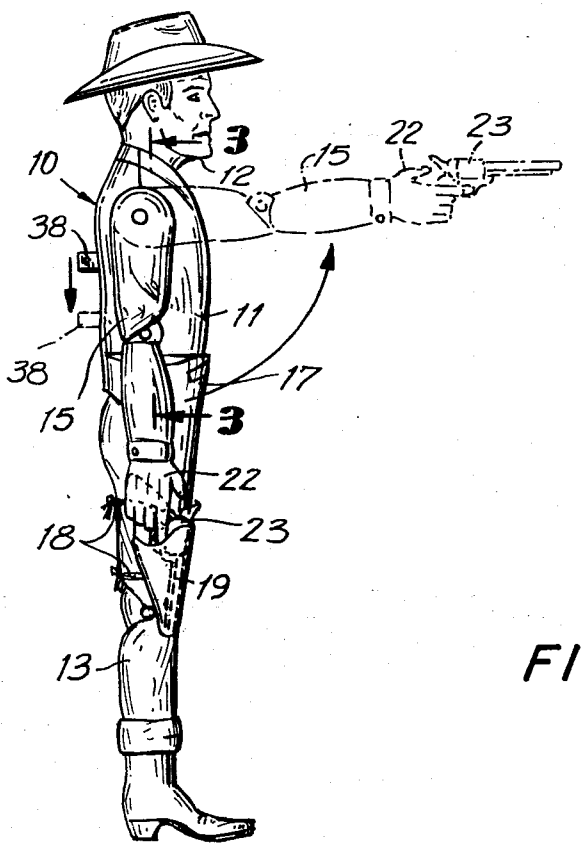
FIG. 1 is a side elevational view of a toy figure incorporating the pistol draw action of the present invention with the pistol being shown in drawn position in phantom lines.

FIGS. 1 and 2 show an articulated toy figure incorporating pistol draw action. FIG. 10 has a torso 11 on which is mounted a head and neck assembly 12, a right leg 13, a left leg 14, a right arm 15 and a left arm 16.

The figure is constructed in a manner known in the art as being fully articulated in that the figure is provided with joints at the shoulder, elbows, hips and knees and the head and neck assembly is rotatably mounted within the torso so that a wide variety of body positions may be simulated for play action by the child.

The figure is provided with a holster belt 17 strapped about the waist of the figure with the lower portions of the holster belt being provided with ties 18 so that the holster 19 is held in an immobile position along the outside of the upper portion of right leg 13. The front edge 21 of holster 19 is open or cut away for purposes hereafter evident.

Secured to the right hand 22 in normal gripping action is a toy pistol 23. As shown in FIGS. 1 and 2, pistol 23 is positioned within holster 19 and is held by right hand 22. Upon operation of the mechanism hereafter described, right arm 15 is raised to the firing position which is the phantom line position shown in FIG. 1. As holster 19 is open along front edge 21, the pistol is freely capable of being withdrawn from the holster as the arm travels along the arc indicated by the arrow in FIG. 1.

Figure 3:
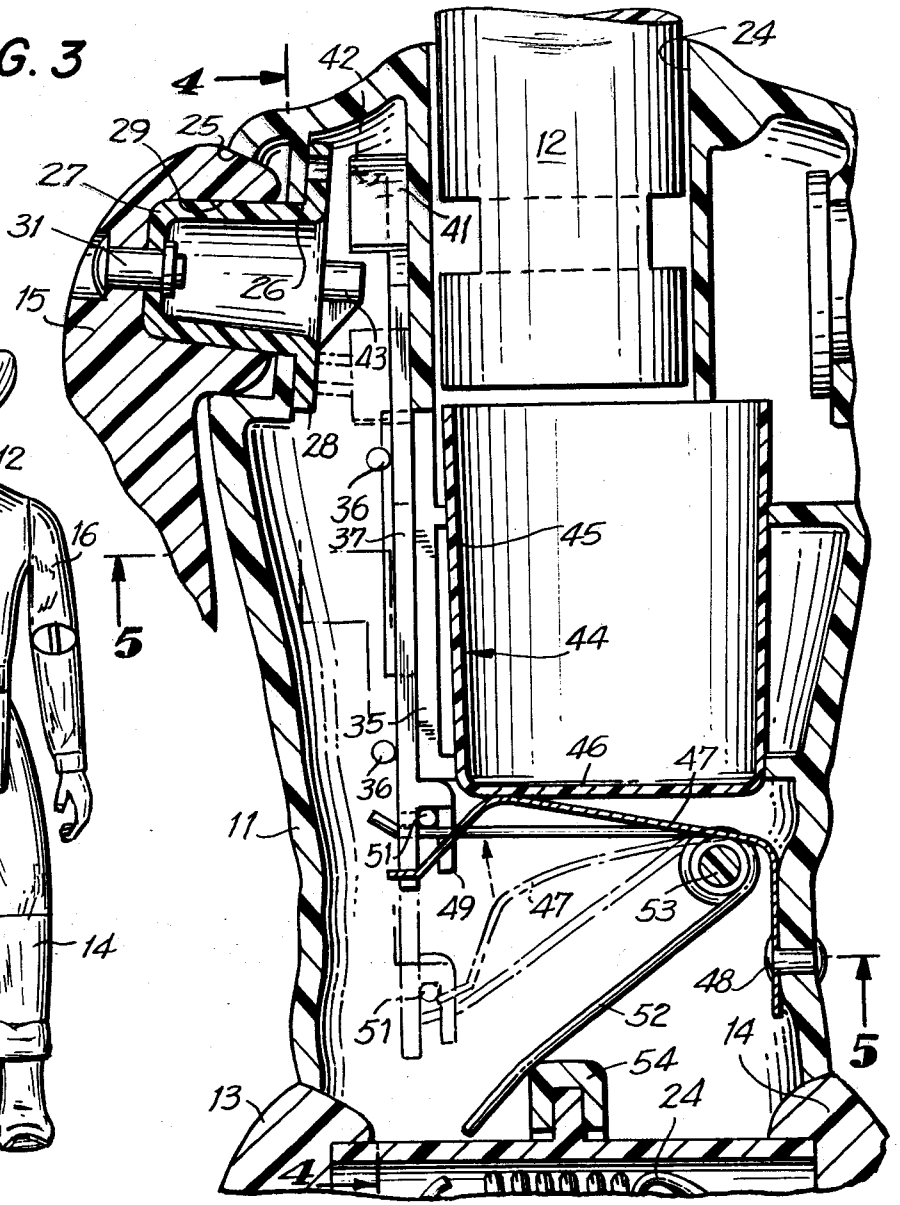
FIG. 3 is a partial sectional view, at an enlarged scale, taken along line 3—3 of FIG. 1.

The mechanism for moving the pistol to the firing position will now be described in connection with FIGS. 3 through 6. Torso 11 which is preferably molded of plastic material has the general configuration of a human torso and is hollow to receive and support the operating mechanism. FIG. 3 shows a portion of right leg 13 and a portion of left leg 14 mounted at the lower end of torso 11 by means of a spring 24 which is partially shown in FIGS. 3 and 4 and which is unrelated to the instant invention. Torso 11 also includes a neck opening 24 into which the head and neck assembly 12 is inserted. At the upper part of torso 11 on the right side, an annular arm opening 25 is provided and spaced inwardly of annular arm opening 25 is an annular flange 26. A connector 27 is in the form of a hollow truncated cone with an annular skirt 28 extending outwardly from the base of connector 27. The top surface of skirt 28 bears against flange 26 with the remainder of connector 27 extending outwardly of torso 11 through arm opening 25. Right arm 15 is provided with a recess 29 which receives connector 27 and is riveted thereto by means of fastener means 31. Right arm 15 and connector 27 are rotatable within the torso to provide swivel action for the right arm. Skirt 28 is provided with an elongated slot 32 and a projection 33 along the periphery of skirt 28 radially beyond elongated slot 32. Connector 27 is preferably fabricated of a resilient plastic material whereby a radially inwardly directed pressure on projection 33 will permit for slight deflection of the projection due to the presence of elongated slot 32. Torso 11 carries, on the inside surface at an area approximating the location of the right shoulder blade a pair of spaced ribs 34 best seen in FIG. 4A. As arm 15 rotates, connector 27 rotates therewith and, when the arm reaches the simulated gun firing position, projection 33 cams over the first of ribs 34 and is retained between the ribs to frictionally hold the pistol in gun firing position as represented by the phantom lines in FIG. 1. Physical rotation of right arm 15 allows projection 33 to be moved out of the FIG. 4A position between ribs 34 in either direction due to the spring action imparted by elongated slot 32. Thus, when right arm 15 is moved from the holstered position to the firing position, cooperation between projection 33 and ribs 34 will retain the right arm and pistol in gun firing position until the position is physically changed by the child.

Torso 11 is provided with an inner vertical wall 35 and a pair of spaced pins 36 defining between the wall and the pins a vertical groove for slidably receiving a plate 37. Plate 37 includes a projecting arm or lever 38 which extends through the back portion of torso 11 through a slot 39 therein. The upper end of plate 37 is provided with a laterally extending arcuate wall 41 which defines a camming surface 42 for cooperation with a pin 43 extending outwardly from skirt 28. Downward movement of lever 38 brings camming surface 42 into cooperating engagement with pin 43 to thereby rotate skirt 28 and connector 27 in the direction of the arrow shown in FIG. 6. Such rotation effects rotation of right arm 15 from the holstered position of pistol 23 to the firing position with projection 33 entering between ribs 34 to hold the right arm in the firing position.

Also mounted within torso 11 is a sound drum 44 having a cylindrical wall 45 and a closed end wall 46. A striker 47 in the form of a generally L-shaped leaf spring is secured at one end to torso 11 by a rivet 48 and a portion of striker 47 rests against the end wall 46 of the sound drum as shown in FIG. 3. A finger 49 is carried by plate 37 at the lower end thereof in spaced relationship with the lower end of the plate. An L-shaped pin 51 has its short end mounted in plate 37 with its long end extending outwardly beyond the plate passing between plate 37 and finger 49. A return spring 52 is coiled about a post 53 carried by torso 11 with one end bearing against a stop 54 and the other end passing through an aperture 55 in plate 37. Return spring 52 aids in holding pin 51 in its mounted position in plate 37 and also acts to bias plate 37 to the raised position and return it to the raised position after it has been moved downwardly by the child by the physical movement of lever 38.

The free end of striker 47 is normally positioned in the path of movement of the outer end of pin 51. As lever 38 is moved downwardly to rotate the right arm from the pistol holstered position to the firing position, pin 51 engages striker 47 to pull it away from sound drum 44. As plate 37 approaches the lower end of its travel, the deflection of striker 47 causes it to ride out of contact with pin 51 as shown in phantom lines in FIG. 3. With a slight additional downward movement of plate 37 from the phantom line position in FIG. 3, striker 47 will be released by pin 51 and allowed to rapidly return to its normal position and strike sound drum 44 to generate an amplified sound simulating that of a pistol being fired. The physical dimensions of the various component parts are selected so that the firing sound is produced at the instant the pistol attains the firing position.

After the pistol has attained the firing position and the sound has been generated, lever 38 is released and returned to the raised position under the action of spring 52. During its upward travel, pin 51 engages the lower surface of striker 47 which tends to block movement of pin 51. As plate 37 continues to move upwardly, pin 51 rotates downwardly or in a counterclockwise direction as viewed in FIG. 6 between the lower end of plate 37 and finger 49 and against the action of spring 52. This allows pin 51 to cam over striker 47 during return action until plate 37 has been raised sufficiently to allow pin 51 to completely clear striker 47 and thereby be returned to the normal FIG. 6 position by the action of return spring 52.

When plate 37 is in its normal fully raised position, wall 41 is located out of the path of movement of pin 43 whereby, for play action, the right arm can be freely positioned. However, when the pistol is holstered and the right arm is in the FIG. 1 full lines position, rapid depression of lever 38 will result in the pistol being rapidly withdrawn from the holster and raised to the firing FIG. 1 phantom line positions and, as the pistol attains the firing position, the sound of the pistol discharging will be simulated and amplified through the torso of the figure through sound drum 44.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A toy figure having a torso, a head, a pair of arms with a hand at the end of each arm and a pair of legs comprising a holster positioned on one leg, means movably mounting one said arm on said torso, a toy pistol carried by the hand at the end of said one arm, said pistol being receivable in said holster and movable from a holstered position wherein said one arm is in a first position along the torso of the figure to a firing position wherein said one arm is in a second position extended outwardly of said torso, and means operating between said torso and said one arm for moving said pistol from said holstered position to said firing position, said operating means including pin means carried by said one arm eccentrically of the axis of rotation thereof and an operating element vertically slidable within said torso, said operating element including a control member extending outwardly of said torso for moving said element and means defining a generally concave camming surface for cooperative engagement with said pin means.

2. A toy figure as claimed in claim 1 and further including pistol firing sound simulating means operated by said pistol moving means.

3. A toy figure as claimed in claim 1 and further including pistol firing sound simulation means operated by said element.

4. A toy figure as claimed in claim 3 wherein said sound means includes a sound producing striking surface, a striker element, and striker element operating means cooperating with said element for operation of said striker element during movement of said element.

5. A toy figure having a torso, a head, a pair of arms with a hand at the end of each arm and a pair of legs comprising a holster positioned on one leg, means movably mounting said arm on said torso, a toy pistol carried by the hand at the end of said one arm, said pistol being receivable in said holster and movable from a holstered position wherein said one arm is in a first position along the torso of the figure to a firing position wherein said one arm is in a second position extended outwardly of said torso, and means operating between said torso and said one arm for moving said pistol from said holstered position to said firing position, said pistol moving means including an element movably mounted within said torso, a control member for moving said element, said control member extending outwardly of said torso for physical operation thereof, and operating means acting between said element and said one arm for effecting rotational movement of said one arm in response to movement of said element, said toy figure further including pistol firing sound simulation means operated by said element and including a sound producing striking surface in the form of a sound drum having a substantially cylindrical outer wall and an end wall, a striker element adapted for striking said end wall, and striker element operating means cooperating with said element for operation of said striker element during movement of said element.

6. A toy figure having a torso, a head, a pair of arms with a hand at the end of each arm and a pair of legs comprising a holster positioned on one leg, means movably mounting one said arm on said torso, a toy pistol carried by the hand at the end of said one arm, said pistol being receivable in said holster and movable from a holstered position wherein said one arm is in a first position along the torso of the figure to a firing position wherein said one arm is in a second position extended outwardly of said torso, and means operating between said torso and said one arm for moving said pistol from said holstered position to said firing position, said pistol moving means including an element movably mounted within said torso, a control member for moving said element, said control member extending outwardly of said torso for physical operation thereof, and operating means acting between said element and said one arm for effecting rotational movement of said one arm in response to movement of said element, said toy figure further including pistol firing sound simulation means operated by said element including a sound producing striking surface, a striker element and striker element operating means cooperating with said element for operation of said striker element during movement of said element, said striker element operating means including a pin pivoted in said element and having a portion thereof in the path of movement of said striker element and spring means operating on said element and said pin for biasing said element to a return position while permitting said pin to cam past said striker element.

* * * * *